United States Patent [19]

Goto et al.

[11] Patent Number: 4,830,357

[45] Date of Patent: May 16, 1989

[54] SORTING MACHINE

[75] Inventors: Chikado Goto, Ibaraki; Kenji Hayashi, Katsuta; Toshio Sakuuchi, Ibaraki, all of Japan

[73] Assignee: Ikegami Tsushinki Co., Ltd., Tokyo, Japan

[21] Appl. No.: 83,461

[22] Filed: Aug. 10, 1987

[30] Foreign Application Priority Data

| | | | |
|---|---|---|---|
| Aug. 20, 1986 | [JP] | Japan | 61-194751 |
| Aug. 20, 1986 | [JP] | Japan | 61-194752 |
| Aug. 20, 1986 | [JP] | Japan | 61-194753 |
| Aug. 20, 1986 | [JP] | Japan | 61-127039[U] |

[51] Int. Cl.[4] ..... B65H 39/10

[52] U.S. Cl. ..... 271/293; 271/208; 271/294; 271/296

[58] Field of Search ..... 271/293, 294, 296, 208

[56] References Cited

U.S. PATENT DOCUMENTS

| | | | |
|---|---|---|---|
| 4,512,565 | 4/1985 | Matsumoto | 271/293 X |
| 4,647,034 | 3/1987 | Sawa | 271/293 |

*Primary Examiner*—Richard A. Schacher

*Attorney, Agent, or Firm*—Oliff & Berridge

[57] ABSTRACT

An extremely compact sorting apparatus includes a plurality of trays, each tray having a pin on each side of an entry portion side where a recorded sheet is received. The tray pins are guided by a vertical guide groove disposed on a frame so as to form a tray entry portion, as cam wheels with slots shift trays one level upwardly or downwardly. A transport plate for guiding a recorded sheet pivotally supports a discharge roller shaft and a cam wheel shaft coaxially. Furthermore, a motor for driving the discharge rollers and a motor for driving the cam wheels are mounted on the transport plate to provide a transport unit. When a recorded sheet is inserted onto the transport plate, it is detected by a detector, so that the drive of the discharge rollers begins and the recorded sheet is discharged to the tray entry portion. When this discharge is completed, the drive of the cam wheels begins so that the trays are shifted by one level. At this time, the cam wheels shift integrally with the transport plate so that the sorting machine is readied for insertion of the next recorded sheet.

17 Claims, 7 Drawing Sheets

SORTING MACHINE

BACKGROUND OF THE INVENTION

The present invention relates to a sorting machine, and more particularly to an extremely compact sorting machine.

A sorting machine, for processing recorded sheets from a photocopier or similar apparatus, is known and in general use in which a pair of transport rollers having a discharge roller and a follow roller are disposed to correspond with individual tray bins. Also known is an arrangement in which individual trays are supported movably by tray pins. A tray entry portion is formed successively by means of a tray entry forming member in an interval between adjoining trays supported in a stack. A transport apparatus, including a discharge roller, is linked and guided to the position corresponding to the above-mentioned tray entry portion, so that recorded sheets sent from a connected machine are discharged successively into the trays.

While conventional sorting machines like those just described each have their own features, however, the easier such machines are to use, the more complex is their arrangement. This means not only that maintenance is expensive, but also that operation is troublesome. For these reasons, and because numerous simpler photocopiers have been developed in recent years, a strong demand has arisen for more compact sorting machines that are easier to use.

SUMMARY OF THE INVENTION

It is therefore an object of the present invention to provide a compact sorting machine having a simple arrangement or construction and a full range of functions, suitable for use with compact photocopiers in particular.

It is a further object of the present invention to provide a sorting machine whose assembly and disassembly are easy and for which maintenance and inspections also are easy.

It is a still further object of the present invention to provide a sorting machine that does not require mechanical or electrical connection with a photocopier, but activates automatically in response to discharge of a recorded sheet from a photocopier so as to offer economical use.

An arrangement of the present invention comprises a transport plate for guiding a recorded sheet from a photocopier to a discharge roller; a plurality of trays supported in a stack and each having a pin or trunnion on each side of an entry portion where the recorded sheet is accepted; guide means for guiding the tray pins in a vertical direction; a pair of cam wheels, each having a slot, that move the trays upwardly and downwardly by rotating around a vertically movable horizontal shaft and coupling the tray pins in the slots, thereby forming a tray entry portion by supporting the pins above and below their circumferences; and means for driving the cam wheels and the discharge roller; the discharge roller and its drive means, the cam wheels and their drive means, and discharge roller shaft and cam shaft support portions being disposed on the transport plate.

In a sorting machine according to the present invention, upper and lower tray pins are kept apart by the upper and lower circumferences of the cam wheels to maintain the tray entry portion in a predetermined interval. The cam wheels that can move the tray pins upwardly and downwardly by their rotation and their drive means, and the discharge roller and its drive means, are constructed integrally with the transport plate as a unit. Consequently, the major portions of the sorting machine are mounted compactly on the transport plate, allowing not only for easy assembly and disassembly, also providing for extremely convenient maintenance, such as inspections and repairs, and contributing to a compact overall size.

Furthermore, it is possible to achieve integration by adding a pinch roller to the unit as arranged above and linking that pinch roller to an upper guide plate, so that at whatever position upwardly or downwardly the drive of the cam wheels puts the tray entry portion, the attitude of the overall unit can be changed automatically to align with that positions.

In a second aspect of the present invention, a sorting machine comprises a lower transport plate on which are disposed a discharge roller and its drive means; a pair of cam wheels and their drive means; support portions for a discharge roller shaft and a cam wheel shaft; and a guide frame that rotatably supports an upper guide plate at the same time that it rotatably supports the lower transport plate, and that can slide freely along vertical guide means. Both ends of the lower transport plate, that is formed into a unit so that the upper guide plate and the lower transport plate move with the guide frame corresponding to an upward or downward movement of the tray entry portion, are supported so that they can move freely along a horizontal guide means. In this manner, regardless of any changes in the position upwardly or downwardly of the tray entry portion due to upward or downward movement of the tray pins due to the drive of the cam wheels, the attitude of the overall unit will automatically change in response to that positioning, thereby allowing recorded sheets to be sent through the newly formed tray entry portion to the corresponding tray along the lower transport plate.

In a third aspect of the present invention, means for activating a drive of the discharge roller is disposed on the lower transport plate which detects a guiding of a recorded sheet inserted from the photocopier to this lower transport plate, thereby allowing for activation without any mechanical or electrical connection to the photocopier.

The present invention also makes it possible to detect a position of the tray entry portion by disposing a light-blocking plate on the guide frame which can slide freely along the vertical guide means, and a photo-interrupter along the guide means, so that the photo-interrupter detects the position of the tray entry portion when the upper guide plate and the lower transport plate are moved with the guide frame corresponding to movement upwardly or downwardly of the tray entry portion.

The above and other objects, effects, features and advantages of the present invention will become more apparent from the following description of preferred embodiments thereof taken in conjunction with the accompanying drawings.

DETAILED DESCRIPTION OF THE PREFERRED EMBODIMENTS

Figure 1:
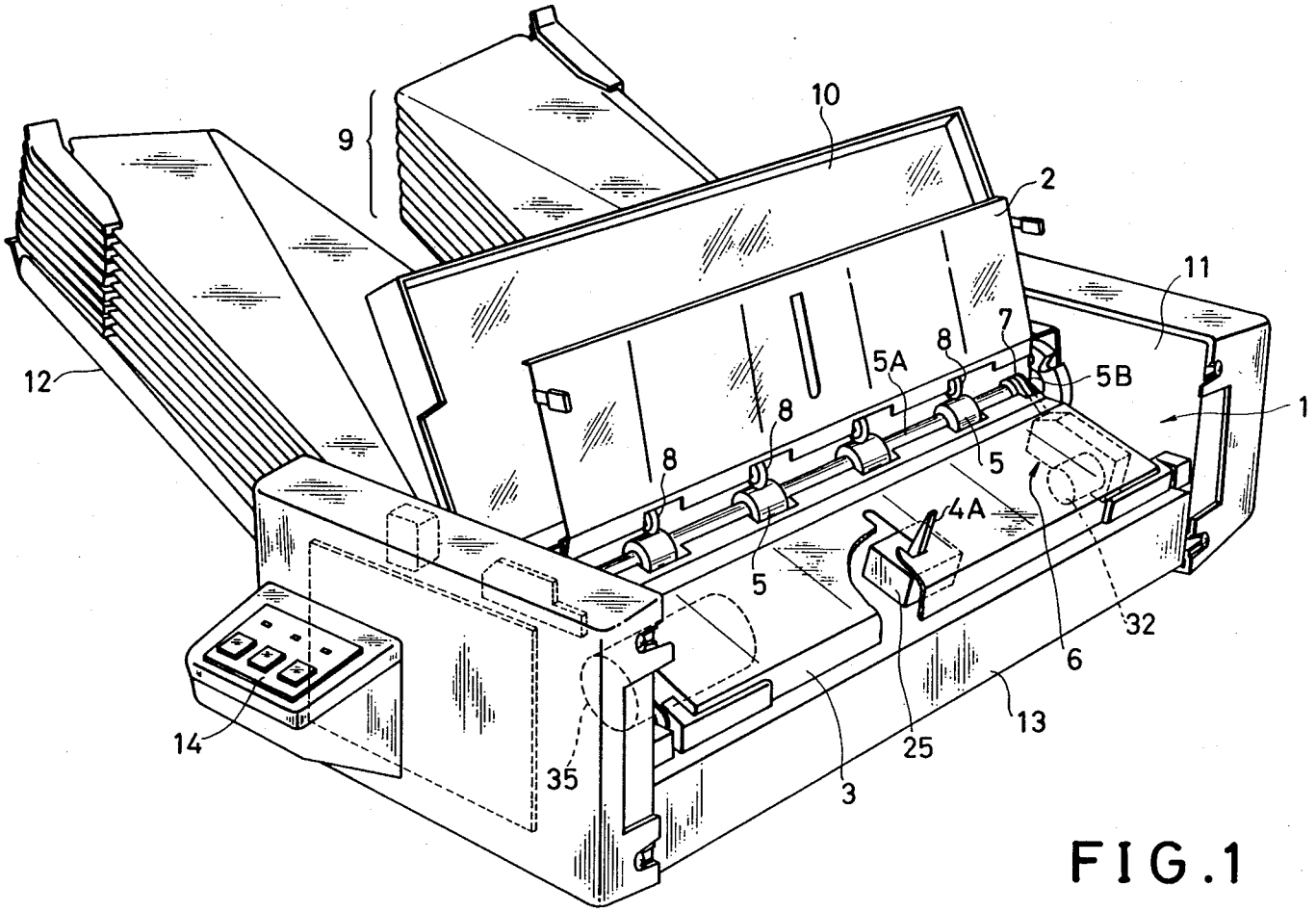
FIGS. 1 and 2 are perspective views showing a recorded sheet insertion side and a tray side respectively of an embodiment of a sorting machine according to the present invention.
Figure 2:
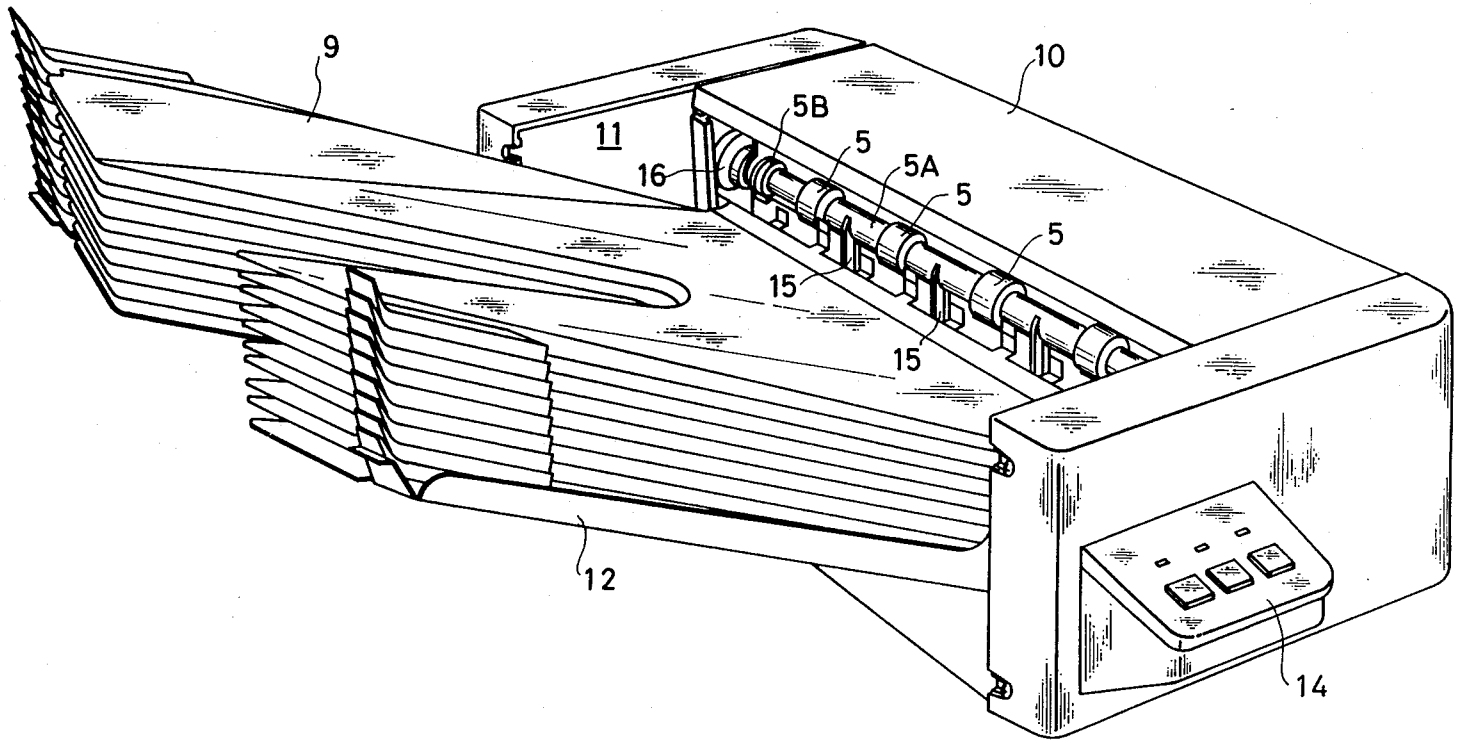
Figure 3:
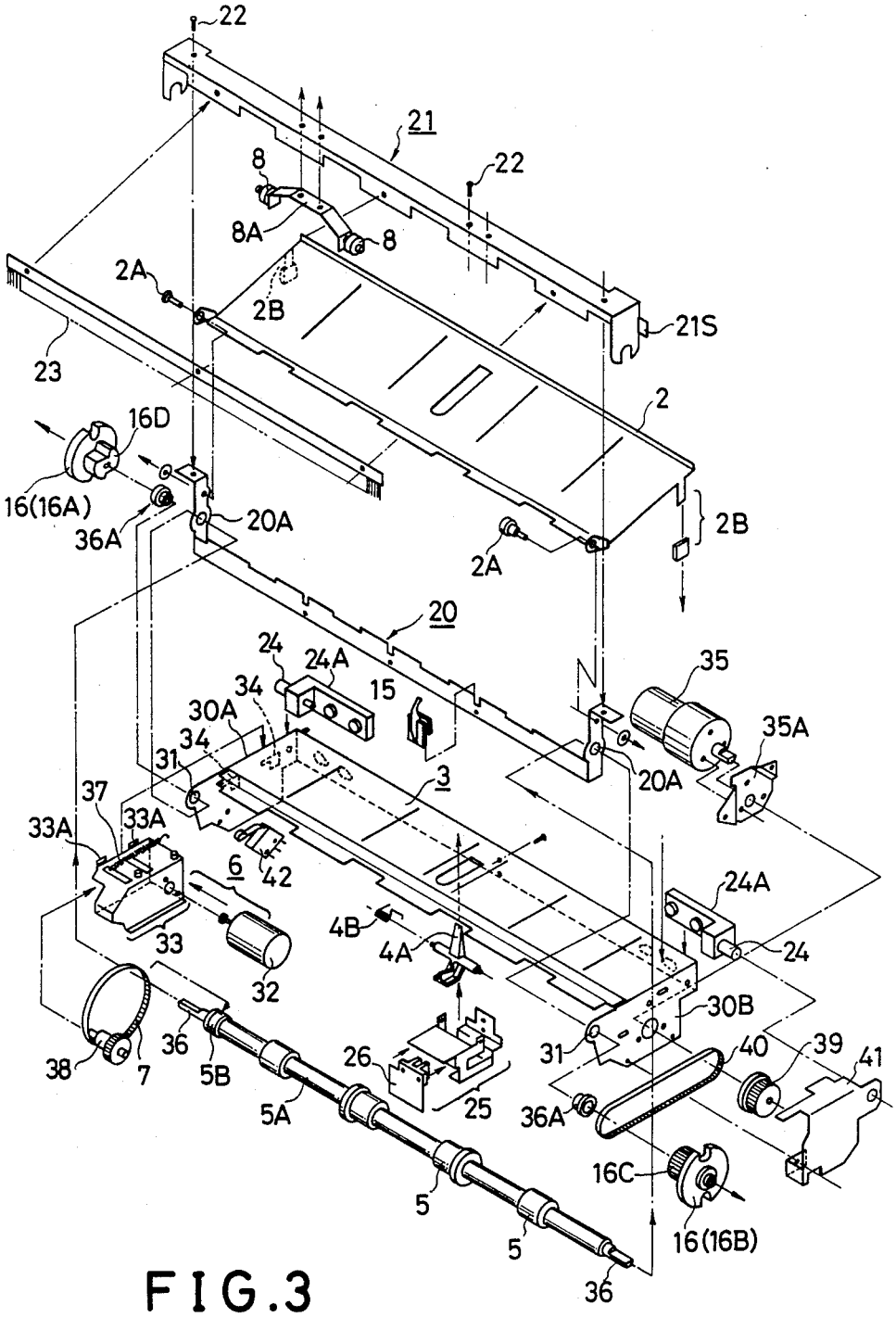
FIG. 3 is an exploded perspective view showing an arrangement of a transport unit according to the present invention.

FIGS. 1 to 3 show an embodiment of the present invention. In FIG. 1, reference numeral 1 denotes a sheet insertion portion which is formed by an upper guide plate 2 and a lower transport plate 3. In FIG. 1, the upper guide plate 2 is shown in the condition in which it has rotated around a support pin 2A, shown in detail in FIG. 3, so that its upper portion is lifted. On the bottom face of the lower transport plate 3 is disposed an inserted sheet detector 25 whose detecting lever 4A protrudes from its top face. When a sheet is inserted, the detecting lever 4A is inclined so that a photosensor described below senses that a sheet is being inserted.

Reference numeral 5 denotes discharge rollers, 5A their roller shaft and 5B a belt pulley disposed on the roller shaft 5A. A belt 7 stretched between the belt pulley 5B and sheet feed drive apparatus 6 (described in detail below) disposed on the lower side of the lower transport plate 3 rotates the discharge rollers 5. The discharge rollers 5 sandwich a recorded sheet against pinch rollers 8 so that the recorded sheet can be discharged to a tray 9.

Reference numeral 10 denotes an upper cover, 11 a side plate frame, 12 a tray holder, 13 a main unit frame, and 14 a control panel for the sorting machine. In FIG. 2, reference numeral 15 denotes a sheet support mounted on a lower guide frame 21, shown in detail in FIG. 3, and preventing the recorded sheet being discharged to the tray 9 by the discharge rollers 5 from being wrapped around the roller shaft 5A. Reference numeral 16 denotes a Geneva-type cam wheel described in detail below.

An explanation of the above principal unit components will be made with reference to FIG. 3. The upper guide plate 2 is swingably supported on both sides of a lower guide frame 20 formed in a substantially U shape by the support pins 2A. This upper guide plate 2 has a support leg 2B on each of its sides. Under regular conditions of use, those support legs 2B make contact with the upper face of the lower transport plate 3, thereby forming a recorded sheet insertion portion 1 between the upper guide plate 2 and the lower transport plate 3.

A U-shaped upper guide frame 21 and the lower guide frame 20 are fixed by a screw 22 so as to form a rectangular shaped guide frame. A pair of pinch rollers 8 are fixed in each of two places on the bottom face of the upper guide frame 21 by a spring member 8A. An elongated static electricity discharge brush 23 is fixed to the front face of the upper guide frame 21.

A block 24A in which a guide pin 24 is embedded is disposed on each edge of the lower transport plate 3. An inserted sheet detector 25 formed of a sheet insertion sensing assembly 26 and supporting a detecting lever 4A and its recoil spring 4B is fixed in the center of the lower face of the lower transport plate 3. Pivot support holes 31 to rotatably support the discharge roller shaft 5A are formed in side plates 30A and 30B of the lower transport plate 3. Furthermore, hooks 33A of a gear assembly 33 combined with a feed motor 32 are slidably engaged as described below in sliding apertures 34 of side plate 30A shown on the left in this drawing. Moreover, a tray motor 35 for driving a tray moving cam wheel 16 is fixed to side plate 30B, shown on the right in this drawing, through a bracket 35A.

The roller shaft 5A is hollow and houses a cam wheel drive shaft 36 coaxially so that both shafts are freely rotatable with respect to each other. In this manner, the roller shaft 5A that is on the outside of this concentric arrangement is supported by penetrating the pivot support hole 20A in the lower guide frame 20 an the pivot support hole 31 disposed in the lower transport plate 3. Furthermore, the cam wheels 16A and 16B are fixed to the ends of cam wheel drive shaft 36 that penetrates bushings 36A disposed at the ends of roller shaft 5A.

A gear assembly 33 is pulled by a tension spring 37 on an incline rising toward the right in FIG. 3. The spring force of this tension spring 37 maintains a tension in the belt 7 that is stretched between a pulley 38 that is driven through the gear assembly 33 and the belt pulley 5B of the roller shaft 5A, thereby preventing unnecessary slippage.

A timing belt 40 is stretched between a toothed pulley 39 fixed on a shaft of a tray motor 35 and a toothed pulley 16C disposed coaxially with the cam wheel 16B.

Reference numeral 41 denotes a belt cover for timing belt 40, and reference numeral 42 denotes a cam switch mounted on left side plate 30A of the lower transport plate 3. Reference numeral 16D denotes a cam member, disposed coaxially with the left side cam wheel 16A, which drives an arm of the cam switch 42.

The above parts as described with reference to FIG. 3 are mutually fixed and/or linked so as to be assembled into a single, integrated unit. A unit arranged in this manner can be detached and attached extremely easily as a totally integrated unit, with the exception of the electrical contact from the main unit, thereby offering a great advantage for maintenance, inspections and/or repairs. Hereinafter, this unit shall be referred to as the tray sorting and transport unit, or, for short, the transport unit.

Figure 4:
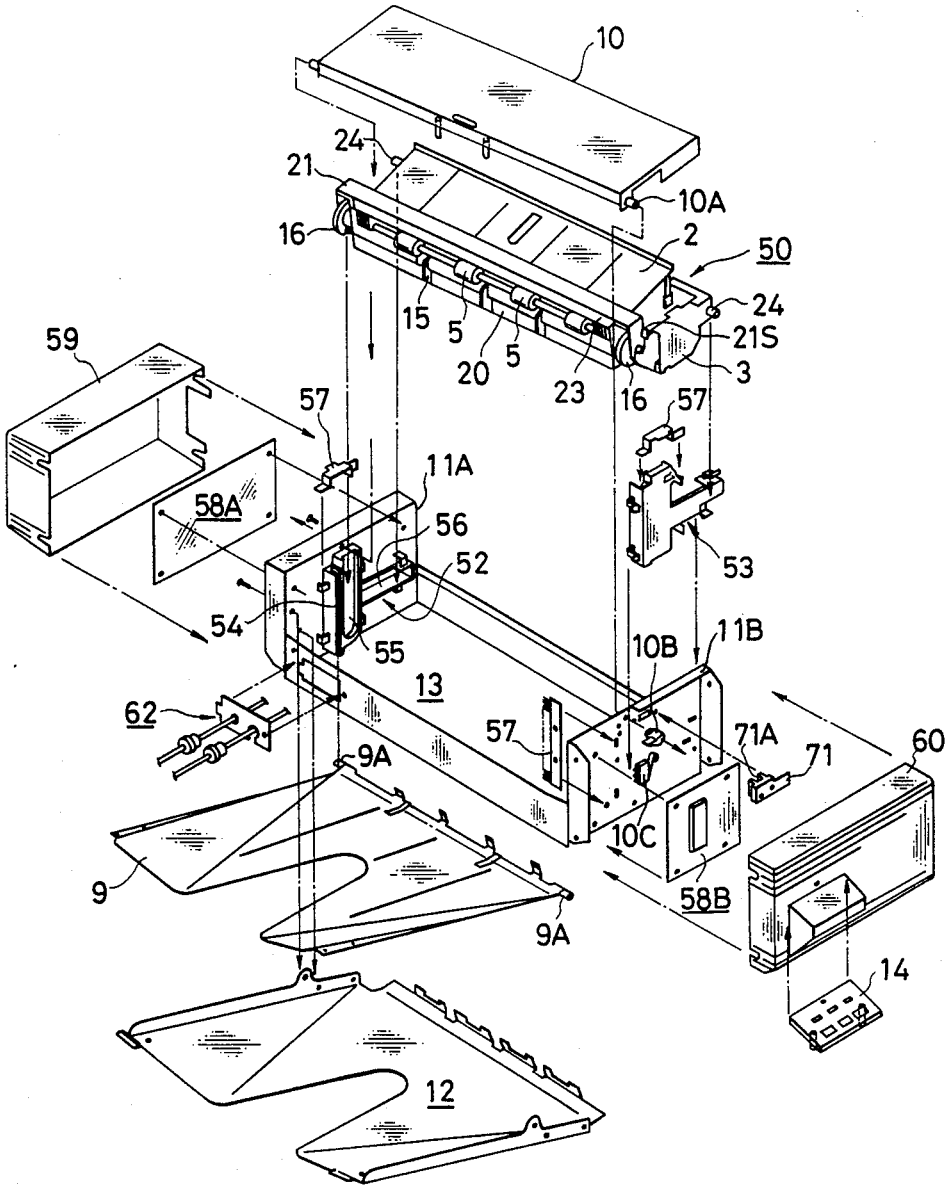
FIG. 4 is an exploded perspective view showing the major portions of a sorting machine according to the present invention.

FIG. 4 shows an overall arrangement. In FIG. 4, reference numeral 50 denotes the above-mentioned transport unit. Reference numeral 13 denotes a main unit frame. On the right and left side plates 11A and 11B are disposed support members 52 and 53 that slidably support the transport unit 50. Vertical pin guide grooves 54 for slidably guiding the tray pins 9A disposed on the edges of the inlet side of the tray 9, vertical sliding grooves 55 for slidably supporting the upper guide frame 21 of the transport unit 50, and horizontal guide grooves 56 for slidably supporting the guide pins 24 of the transport unit 50 are formed in support members 52 and 53 on sides thereof away from sidewalls 11A and 11B.

That is, by dropping both sides of the upper guide frame 21 into vertical sliding grooves 55 from the top, and inserting the guide pins 24 into the horizontal guide grooves 56, the transport unit 50 can be attached to the main unit frame 13 in a swingable condition. A groove cover 57 is fitted on each sliding groove 55. Furthermore, the tray holder 12 is fixed to the sidewalls 11A and 11B of the frame 13 with screws. A static electricity discharge brush 57 is disposed vertically on the sidewall 11B. This allows for further removal of static electricity occurring in the stacked recorded sheets that are discharged to the trays 9. Consequently, it is desirable that, when the tray 9 itself is made of metal, its surface be coated with an insulator.

Reference numerals 58A nd 58B denote printed circuit boards including control circuits, reference numerals 59 and 60 rear and front covers, 14 a control panel, and 62 a cords insertion portion.

An explanation will now be made of a drive portion of cam wheels 16 with reference to FIG. 5. As explained with reference to FIG. 3, the tray motor 35 is fixed to the sidewall 30B of the lower transport plate 3 through a toothed pulley 39 mounted on the shaft of the motor 35, and a toothed pulley 16c mounted on the cam wheel drive shaft 36 drives and rotates the cam wheels 16 disposed on the sides of lower transport plate 3. Each cam wheel 16 has pin feed slots 66 separated by an interval of 180°. These slots 66 are disposed at the same phase on each cam wheel 16.

Figure 5:
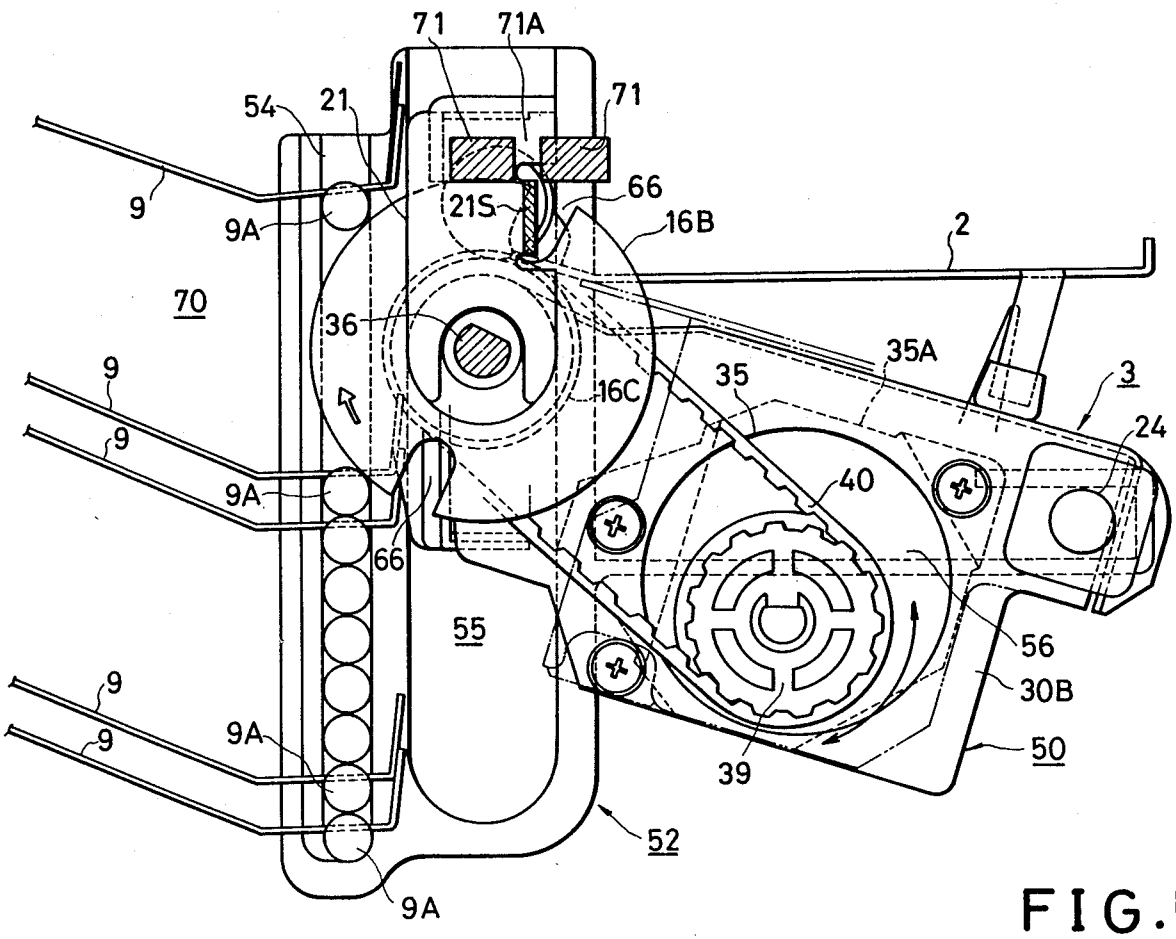
FIG. 5 is a side view showing schematically an arrangement of a cam wheel drive mechanism.

In the condition as shown in FIG. 5, when the motor 35 rotates the cam wheel 16B in a clockwise direction, the tray pin 9A that was in contact with the adjacent circumference of cam wheel 16B engages in the slot 66 positioned at the bottom of cam wheel 16B. The guide frame supporting cam wheel 16B is guided freely upwardly and downwardly by the sliding grooves 55, so that pin 9A is lifted upwardly along the guide groove 54 with the pin 9A still engaged in the slot 66. Following this, when slot 66 has rotated to the top position, the tray pin 9A disengages from slot 66 and is supported in contact with the circumferences of cam wheel 16B. On the other hand, during the action just described, the lower portion of the circumference of cam wheel 16B makes contact with the pin 9A positioned beneath the pin 9A that has just been lifted up, forming or shifting a tray entry 70 in the interval with the tray one level lower than shown in the drawing. The cam member 16D that is disposed coaxially with the cam wheel 16A (see FIG. 6) has two notches 16K on its circumference, so that when the cam wheel 16A makes a half rotation and completely moves the pin 9A, that is when the pin 9A disengages from the slot 66, the arm of the cam switch 42 shown in FIG. 3 engages in the notch portion 16K, turning off the switch and stopping the tray motor 35.

This therefore permits the shifting of successive tray entries 70, so that, although no explanation will be made with reference to the drawings, when a tray 9 is to be moved from an upper to a lower position, it is enough that the cam wheels 16 are rotated in a counter-clockwise direction by switching the direction of rotation of the motor 35. In any case, half rotation of the cam wheels 16 can move a tray 9 one level upwardly or downwardly.

One portion of the side plate of the upper guide frame 21 is cut out and bent to form a light-blocking plate 21S. On the other hand, on the side of the upper portion of the sliding groove 55 in which the upper guide frame 21 slides is fitted a photo-interrupter 71 as a light sensor. Consequently, when the light-blocking plate 21S is positioned in the light-blocking groove 71A of the photo-interrupter 71, the home position of a tray 9 is detected by obstruction of the light. Moreover, although not shown in the drawings, it is possible to detect the positions of individual trays by disposing this type of photo-interrupter 71 in a vertical array along the groove 55.

Figure 6:
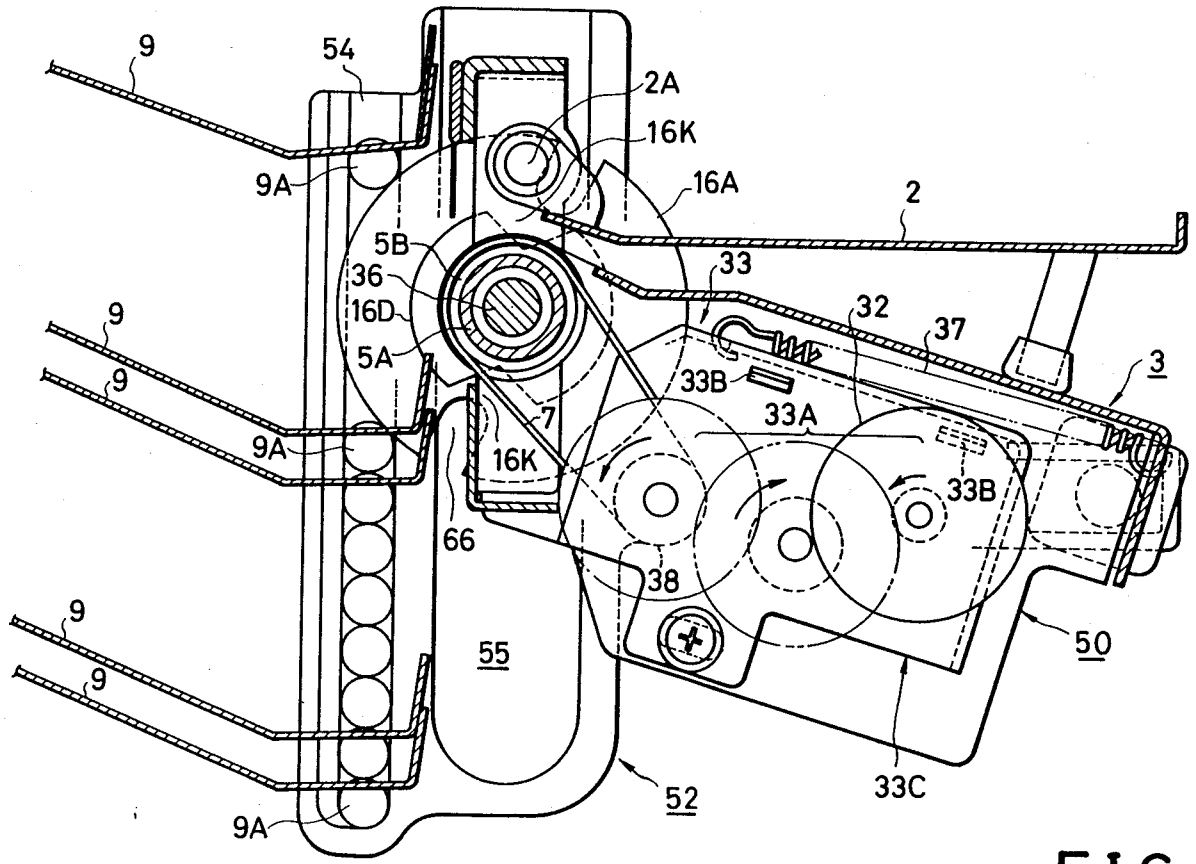
FIG. 6 is a side view showing schematically an arrangement of a discharge roller drive mechanism.

Next, a detailed explanation will be made of the sheet feeding mechanism for discharging the recorded sheet with reference to FIG. 6.

In the gear assembly 33, a hook 33B engages in a guide groove 34 of the left side late 30A of the lower transport plate 3 and is freely slidably (refer to FIG. 3). Furthermore, a gear train 33A that is driven by a feed motor 32 is disposed inside a gear assembly case 33C. The belt 7 drives the roller shaft 5A with reduced rotation through the gear train 33A. Moreover, a tension spring 37 is stretched between the gear assembly case 33C and the entry side edge plate of the lower transport plate 3. The spring force of this spring 37 maintains a suitable tension in the belt 7, at the same time as it prevents an excessive load from being applied to the feed motor 32.

Next, an explanation will be made of the action when a recorded sheet is discharged to a tray with reference to FIG. 7.

When the recorded sheet (not shown) is guided from the right side of the drawing in the manner as shown by an arrow A, the detecting lever 4A of the sheet detection unit 25 is tilted when the recorded sheet passes between the upper guide plate 2 and the lower transport plate 3, assuming the attitude as shown by the imaginary lines. With this, the light-blocking arm 4C that is linked to the detection lever 4A is removed from the light path of the photo-interrupter 26A that is disposed on the sheet detection unit 25, so that the insertion of a recorded sheet is sensed. This sensing signal activates the feed motor 32 (refer to FIG. 6), so that the roller shaft 5A rotates an the recorded sheet is sandwiched against the pinch rollers 8 and then discharged to the tray entry 70 of the predetermined tray 9.

Next, when the recorded sheet is discharged, the detection lever 4A of the actuator 4 is uprighted by the spring force of the spring 4B described earlier with reference to FIG. 3. When this lever 4A returns to the position as shown in the drawing, a signal from the photo-interrupter 26A stops the feed motor 32, thereby stopping the sheet feeding.

This signal from the photo-interrupter 26A is used simultaneously as the signal to activate the tray motor 35. When the tray motor 35 rotates, the cam wheels 16 begin rotating, thereby performing the action to form a tray entry at the next level, that is the tray shift action as described above. With this shift action, the upper guide frame 21 is guided in the sliding grooves 55, and the guide pins 24 are guided in the horizontal guide grooves 56, in such a way that the transport unit 50 rotates around an instantaneous center.

Further, when the upper cover 10 is lifted up in the condition as shown in FIG. 1, an interlock cam 10B disposed in relation to its rotating shaft 10A as shown in FIG. 4 activates an interlock switch 10C, putting the entire sorting apparatus into an interlock conditions.

Figure 7:
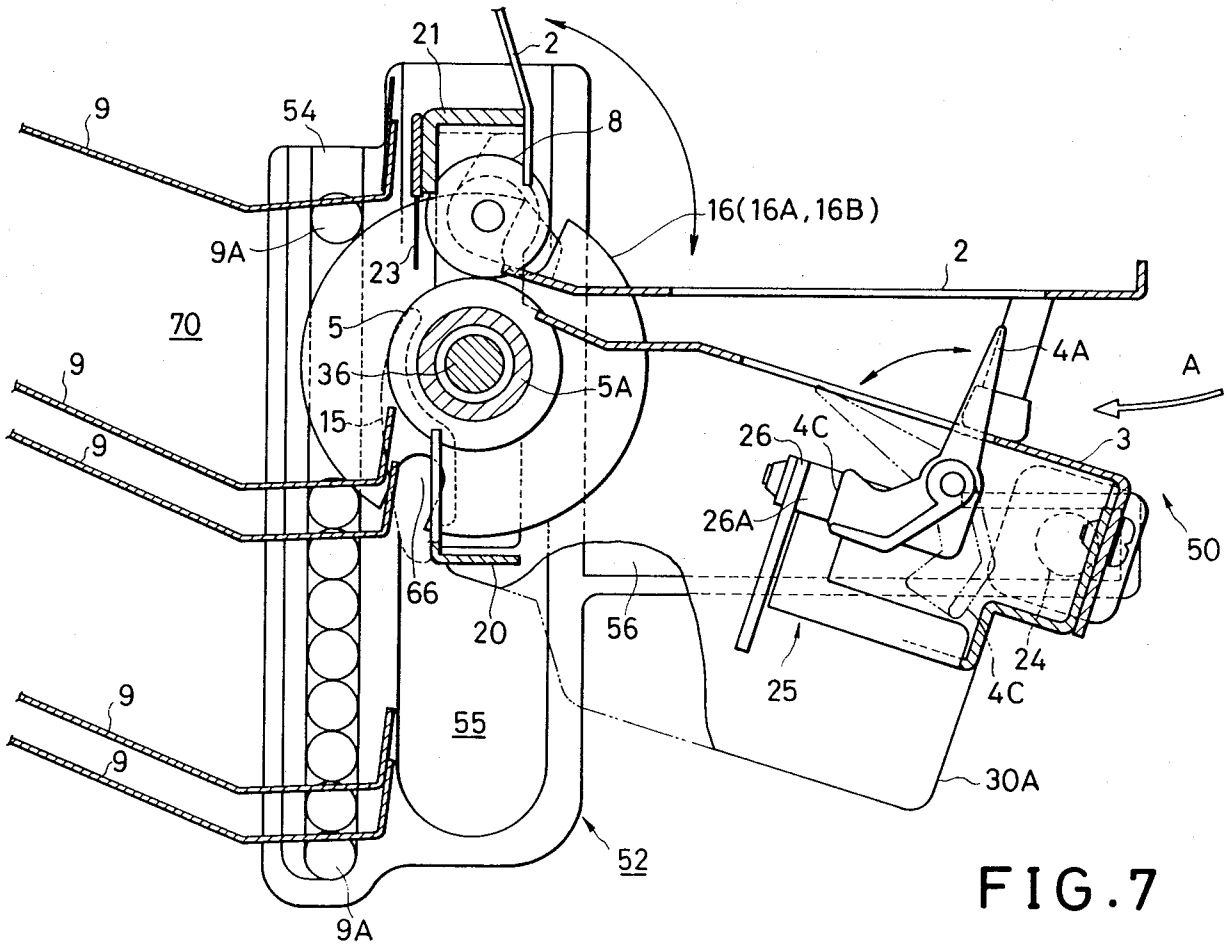
FIG. 7 is a side view, partly in cross-section, showing an arrangement of a recorded sheet insertion portion in a sorting machine according to the present invention.

Furthermore, the recorded sheet sandwiched between the discharge rollers 5 and the pinch rollers 8 and discharged to the tray entry 70 side has any charged static electricity removed by the static electricity discharge brushes 23 and 57 as shown in FIGS. 3, 4 and 7.

What is claimed is:

1. A sorting machine comprising:

a frame;

a plurality of trays, each having a pin disposed on each side of an entry portion side where recorded sheets are received;

means disposed on said frame for guiding said tray pins in a substantially vertical direction;

a pair of cam wheel, each mounted on a horizontal shaft and having at least one slot that is engageable with one of said tray pins, for moving said trays upwardly and downwardly and supporting each of said pins above and below it circumference so as to form a tray entry portion;

a transport plate having a side plate on each edge thereof for guiding said recorded sheets;

a discharge roller mounted on a shaft which is coaxially externally disposed with respect to said horizontal shaft and is rotatably supported on said side plates of said transport plate;

an upper guide plate;

a guide frame that swingably supports said upper guide plate and at the same time rotatably supports said transport plate;

means fixed to said guide frame on a discharge side thereof for discharging static electricity from said recorded sheets;

means disposed on said frame for guiding said guide frame in a substantially vertical direction;

means mounted on said transport plate for driving said discharge roller;and means mounted on said transport plate for driving said cam wheels.

2. A sorting machine as claimed in claim 1, wherein said means for guiding said guide frame in a substantially vertical direction comprises a first groove disposed in a support member fixed to said frame, said guide frame engaging slidably in said first groove.

3. A sorting machine as claimed in claim 2, wherein said means for guiding said tray pins in a substantially vertical direction is a second groove in which said tray pins engage, said second groove being formed in said support member fixed to said frame and being parallel to said first groove.

4. A sorting machine as claimed in claim 1, wherein said guide frame includes an upper portion and a lower portion, said upper guide frame portion supporting a pinch roller in contact with said discharge roller.

5. A sorting machine as claimed in claim 1, further comprising:

means disposed on said guide frame for blocking light; and optical detecting means, disposed in an array along a guide groove in which said guide frame slidably engages, for detecting a position of said light blocking means.

6. A sorting machine as claimed in claim 1, further comprising:

a switch that activates in response to a slot position of at least one of said cam wheels; and means for stopping said cam wheel driving means by an action of said switch.

7. A sorting machine as claimed in claim 1, further comprising:

a plurality of discharge rollers mounted on said discharge roller shaft; and a plurality of recorded sheet supports, each mounted on said guide frame and arranged between adjacent discharge roller to prevent recorded sheets from being wrapped around said discharge roller shaft.

8. A sorting machine comprising:

a frame;

a plurality of trays, each having a pin disposed on each side of an entry portion side where recorded sheets are received;

means disposed on said frame for guiding said tray pins in a substantially vertical direction;

a pair of cam wheels, each mounted on a horizontal shaft and having at least one slot that is engagable with one of said tray pins, for moving said trays upwardly and downwardly and supporting each of said pins above and below its circumference so as to form a tray entry portion;

a transport plate having a side plate on each edge thereof form guiding said recorded sheets, said side plates rotatably supporting said horizontal shaft;

a guide pin disposed on each said side plate at a recorded sheet insertion side thereof;

a discharge roller mounted on a shaft which is rotatable support on said side plates of said transport plate;

an upper guide plate;

a guide frame that swingably supports said upper guide plate and at the same time rotatably supports said transport plate;

means disposed on said frame for guiding said guide frame in a substantially vertical direction;

means disposed on said frame for guiding said transport plate guide pins in a substantially horizontal direction;

means mounted on said transport plate for driving said discharge roller, said driving means comprising a first pulley disposed on said discharge roller shaft, a member supporting a second pulley that is driven by a motor through a gear assembly, a belt stretched between said first and second pulleys, and means for applying tension to said belt, said supporting member being mounted slidably on one side plate of said transport plate; and means mounted on said transport plate for driving said cam wheels.

9. A sorting machine as claimed in claim 8, wherein said horizontal shaft is coaxial with said discharge roller shaft and is disposed inside that shaft.

10. A sorting machine as claimed in claim 8, wherein said means for guiding said guide frame in a substantially vertical direction comprises a first groove disposed in a support member fixed to said frame, said guide frame engaging slidably in said first groove.

11. A sorting machine as claimed in claim 10, wherein said means for guiding said tray pins in a substantially vertical direction s a second groove in which said tray pins engage, said second groove being formed in said support member fixed to said frame and being parallel to said first groove.

12. A sorting machine as claimed in claim 11, wherein said means for guiding said transport plate guide pins ina substantially horizontal direction is a third groove in which said transport plate guide pins engage, said third groove being formed in said support member fixed to said frame.

13. A sorting machine as claimed in claim 8, further comprising:

means for sensing that a recorded sheet is being inserted onto said transport plate and activating said discharge roller drive means.

14. A sorting machine as claimed in claim 8, wherein said guide frame includes an upper portion and a lower portion, said guide frame portion supporting a plurality of pinch rollers each being independently in contact with said discharge roller.

15. A sorting machine as claimed in claim 8, further comprising:

means disposed on said guide frame for blocking light; and optical detecting means, disposed in an array along a guide groove in which said guide frame slidably engages, for detecting a position of said light blocking means.

16. A sorting machine as claimed in claim 8, further comprising:

a switch that activates in response to a slot position of at least one of said cam wheels; and means for stopping said cam wheel driving means by an action of said switch.

17. A sorting machine as claimed in claim 8, further comprising:

a plurality of discharge rollers mounted on said discharge roller shaft; and a plurality of recorded sheet supports, each mounted on said guide frame and arranged between adjacent discharge rollers to prevent recorded sheets from being wrapped around said discharge roller shaft.

* * * * *